US009681712B2

(12) United States Patent
Dudden

(10) Patent No.: US 9,681,712 B2
(45) Date of Patent: Jun. 20, 2017

(54) KEY RING METHOD AND APPARATUS

(71) Applicant: JoJo Rings, LLC, Syracuse, NY (US)

(72) Inventor: Jordan Nicole Dudden, Syracuse, NY (US)

(73) Assignee: JoJo Rings, LLC, Syracuse, NY (US)

( * ) Notice: Subject to any disclaimer, the term of this patent is extended or adjusted under 35 U.S.C. 154(b) by 173 days.

(21) Appl. No.: 14/796,930

(22) Filed: Jul. 10, 2015

(65) Prior Publication Data

US 2017/0006980 A1 Jan. 12, 2017

(51) Int. Cl.

| | |
|---|---|
| ***A44C 27/00*** | (2006.01) |
| ***B21D 53/44*** | (2006.01) |
| ***B21D 5/01*** | (2006.01) |
| ***A44C 9/00*** | (2006.01) |
| ***B21D 53/16*** | (2006.01) |

(52) U.S. Cl.

CPC ..... *A44C 27/002* (2013.01); *A44C 9/00* (2013.01); *B21D 5/01* (2013.01); *B21D 53/44* (2013.01); *A44C 9/0015* (2013.01); *A44C 9/0076* (2013.01); *B21D 53/16* (2013.01); *Y10T 29/21* (2015.01); *Y10T 29/49593* (2015.01)

(58) Field of Classification Search

CPC ..... A44C 9/00; A44C 9/0015; A44C 9/0076; A44C 27/00; A44C 27/001–27/002; Y10T 29/21; Y10T 29/49593; B21D 5/01–5/015; B21D 53/16–53/18; B21D 11/02; B21D 11/10; B21D 11/203; B21D 5/00; B21D 5/008; B21D 53/44

USPC ..... 63/15

See application file for complete search history.

(56) References Cited

U.S. PATENT DOCUMENTS 2,066,004 A * 12/1936 Hitt ..... B21C 37/0815 72/401

OTHER PUBLICATIONS

[username] scooter76, "Volkswagen (VW) Ring from Old Key", May 5, 2014, Instructables, https://www.instructables.com/id/Volkswagan-VW-Ring-from-Old-Key/.*

* cited by examiner

*Primary Examiner* — Christopher Besler
*Assistant Examiner* — Matthew P Travers
(74) *Attorney, Agent, or Firm* — Boisbrun Hofman, PLLC

(57) ABSTRACT

A method for fabricating a fashion ring from a key is presented. The method includes supporting the key on first and second surfaces, forcing the key into a shaping aperture between the first and second surfaces with a round form, wrapping a first portion of the key around the round form with a first die, wrapping a second portion of the key around the round form with a second die, removing the wrapped key from the round form, and applying a finishing process to the wrapped key to form a fashion ring.

8 Claims, 6 Drawing Sheets

KEY RING METHOD AND APPARATUS

TECHNICAL FIELD

The present disclosure is directed, in general, to methods of fabricating fashion rings, and more specifically, to methods of fabricating fashion rings from recycled keys.

BACKGROUND

Locksmiths often have surplus keys. Such keys may include blank keys for types of locks that are no longer supported by the locksmith, used by the locksmith's customers, or marketed by a lock manufacturer. Surplus keys may also include keys that were cut to fit locks that have been rekeyed. Such surplus keys may be disposed of in landfills or may be sorted by metallic composition and put through a recycling process along with other pieces of scrap metal.

SUMMARY OF THE DISCLOSURE

According to a first embodiment of the present disclosure, a method of fabricating a fashion ring from a key includes supporting a bow portion of the key on a first surface and a blade of the key on a second surface. The method further includes forming a wrapped key around a round form by pressing a round form into an intermediate portion of the key, located between the bow portion and the blade end portion, to force the key into a shaping aperture between the first and second surfaces, such that the intermediate portion of the key wraps at least partially around the round form, while a distal portion of the bow portion and a distal portion of the blade remain substantially straight. Forming a wrapped key also includes pressing a first die into the distal portion of the bow portion to wrap the distal portion of the bow portion around the round form, and pressing a second die into the distal portion of the blade end to wrap the distal portion of the blade end around the round form. The method further includes removing the wrapped key from the round form, and applying a finishing process to the wrapped key to form a fashion ring.

According to a second embodiment of the present disclosure, a method of fabricating a fashion ring from a key includes placing the key on an anvil die, the anvil die having a first surface contacting a portion of a bow portion of the key, a second surface contacting an end portion of a blade of the key, and a shaping aperture between the first and second surfaces under an intermediate portion of the key located between the portion of the bow portion of the key and the end portion of the blade of the key. The method also includes pressing a round form into the intermediate portion of the key, to force the intermediate portion of the key into the shaping aperture and at least partially wrap the key around a first portion of the round form. The method further includes, while the key is held in the shaping aperture by the round form, pressing a first die into the portion of the bow portion of the key, to force the portion of the bow portion of the key to at least partially wrap around a second portion of the round form, and pressing a second die into the end portion of the blade of the key, to force the end portion of the blade of the key to at least partially wrap around a third portion of the round form, thereby forming a fully wrapped key. The method also includes removing the fully wrapped key from the round form and treating the fully wrapped key to produce a desired finish.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

A method and apparatus are described for fabricating a fashion ring from a key by wrapping the key around a form having a diameter selected to correspond to a desired ring size. The key is wrapped around the form by a plurality of operations of a press apparatus. The wrapped key is further processed to have a desired finish, surface property, or coating.

Figure 12:
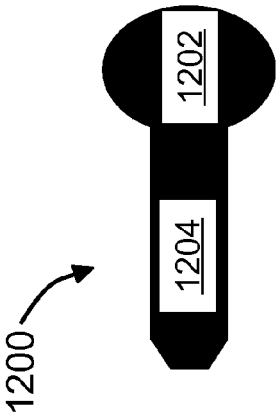
FIG. 12 shows a side view of an exemplary key.

FIGS. 1-6 show a first apparatus performing steps in a first method according to the disclosure. FIG. 12 shows an exemplary key 1200 that may be used in methods according to the disclosure to fabricate a fashion ring. The key 1200 includes a bow portion 1202 and a blade portion 1204.

Figure 1:
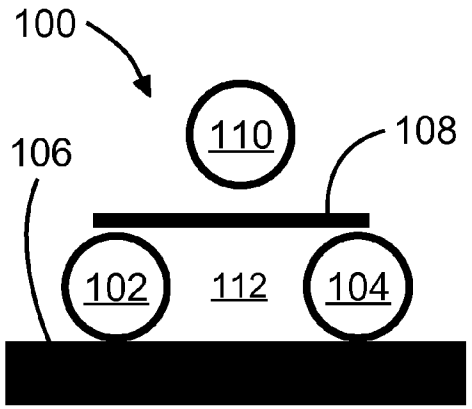
FIGS. 1-6 show a first apparatus performing steps in a first method according to the disclosure.

Returning to FIG. 1, a press apparatus 100 includes a base 106, to which are fixedly attached press anvils 102 and 104. The press apparatus 100 also includes a press ram 110. The press ram 110 provides a round form for shaping a key 108 into a ring, as described below. As shown in FIG. 1, the press ram 110 may be raised above the press anvils 102 and 104. In a first step of the method, the key 108 may be placed or held across the press anvils 102 and 104 in a position that the press anvil 104 supports a blade end portion of the key 108 and the press anvil 102 supports a bow portion of the key 108. An intermediate portion of the key 108 extends across a shaping aperture 112 existing between the press anvils 102 and 104.

Figure 2:
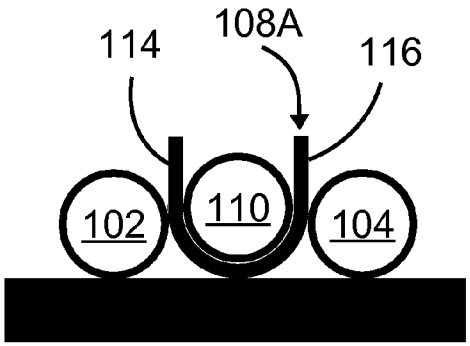

In a second step of the method, the press ram 110 is operated to press the intermediate portion of the key 108 into the shaping aperture 112, thereby wrapping the key 108 around a portion of the press ram 110, forming a partially wrapped key 108A, as shown in FIG. 2. A distal portion 114 of the bow portion of the partially wrapped key 108A and a distal portion 116 of the blade portion of the partially wrapped key 108A remain substantially straight after the intermediate portion of the key 108 is pressed into the shaping aperture 112.

Figure 3:
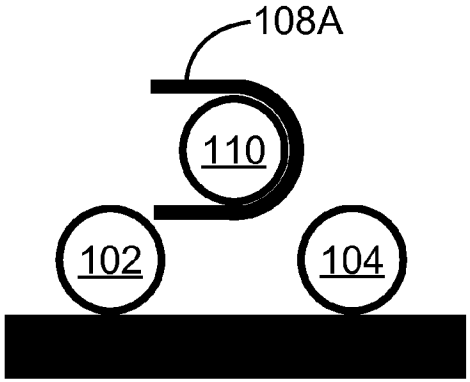

As shown in FIG. 3, the press ram 110 is again raised above the press anvils 102 and 104, this time with the partially wrapped key 108A still positioned around a portion of the press ram 110. The partially wrapped key 108A is then rotated to bring the distal portion 114 of the bow portion of the partially wrapped key 108A into a position adjacent to the press anvil 102. The partially wrapped key 108A may be held in the position shown in FIG. 3.

Figure 4:
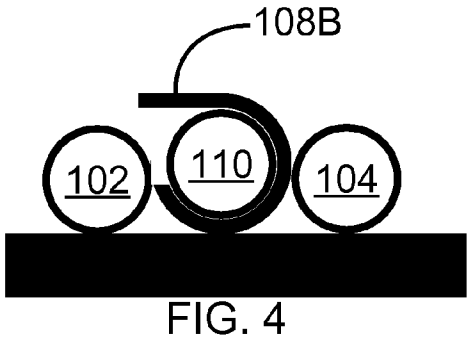

FIG. 4 shows that the press ram 110 is again operated, this time to press the partially wrapped key 108A into the shaping aperture 112. This presses the distal portion 114 of the bow portion of the partially wrapped key 108A against the press anvil 102, wrapping the distal portion 114 of the partially wrapped key 108A around a portion of the press ram 110, and forming a partially wrapped key 110B.

Figure 5:
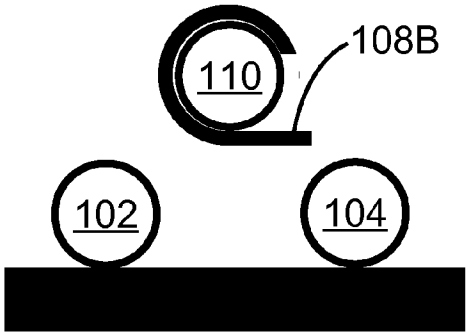

As shown in FIG. 5, the press ram 110 is again raised above the press anvils 102 and 104, this time with the partially wrapped key 108B still positioned around a portion of the press ram 110. The partially wrapped key 108B is then rotated to bring the distal portion 116 of the blade portion of the partially wrapped key 108B into a position adjacent to the press anvil 104. The partially wrapped key 108B may be held in the position shown in FIG. 5.

Figure 6:
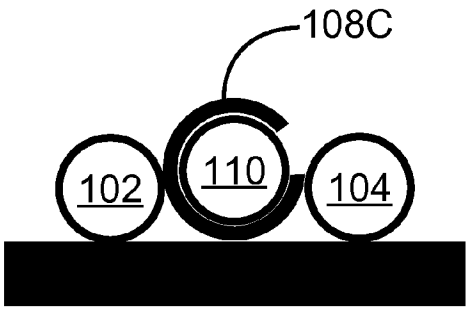

FIG. 6 shows that the press ram 110 is again operated, this time to press the partially wrapped key 108B into the shaping aperture 112. This presses the distal portion 116 of the blade portion of the partially wrapped key 108B against the press anvil 104, wrapping the distal portion 116 of the partially wrapped key 108A around a portion of the press ram 110, and forming a wrapped key (or ring) 108C.

If further portions of the distal ends 114 and 116 of the bow portion and blade portion, respectively, of the wrapped key 108C remain straight, the steps of the method shown in FIGS. 3-6 may be repeated until the wrapped key obtains a desired degree of circularity. That is, the press anvil 110 may be raised, the wrapped key 108C rotated to a new position, and the press ram 110 operated to press the wrapped key 108C into the shaping aperture 112 until no unacceptably straight portions of the distal ends 114 and 116 remain, or until the wrapped key 108C otherwise obtains a desired degree of circularity.

Figure 7:
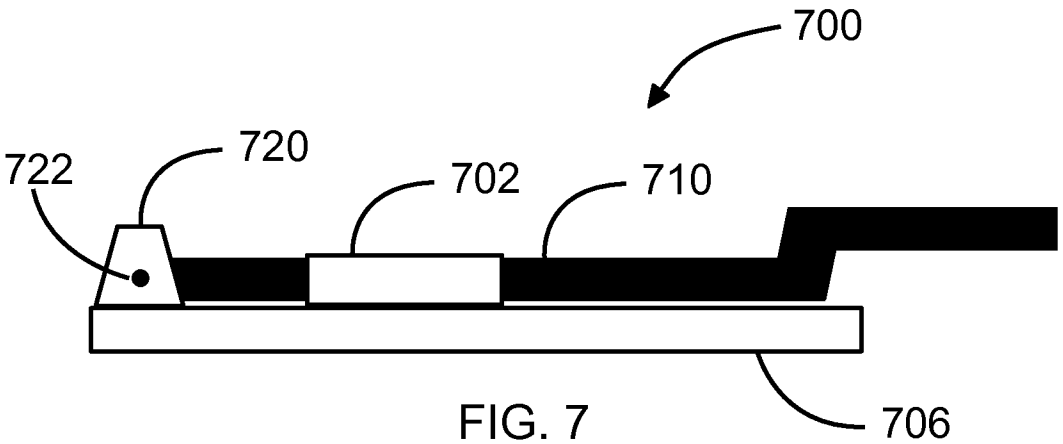
FIG. 7 presents a schematic view of an apparatus according to the disclosure for performing the first method.

FIG. 7 presents a schematic view of an apparatus 700 according to the disclosure for performing the first method, viewed from the side. A base 706 includes a pivot mount 720. A press ram 710 having a round cross section is pivotally attached at one end to the pivot mount 720 by pivot 722. The opposite end of the press ram 710 comprises a handle for manually operating the press ram 710. When lowered to the base 706, the press ram 710 is positioned between a first press anvil 702 and a second press anvil (not shown in FIG. 7). It may be seen that the press ram 710 may be repeatedly raised and lowered to form a key into a fashion ring, as described with reference to FIGS. 1-6. While the press ram 710 shown in FIG. 7 is manually operated, it will be understood that in other embodiments an actuator may mechanically raise and lower the press ram 710.

Figure 8:
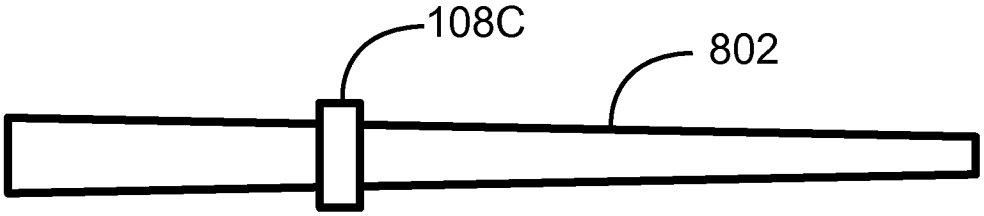
FIG. 8 illustrates a schematic view of an apparatus for adjusting a size of a ring fabricated according to the disclosure.

FIG. 8 illustrates a schematic view of an apparatus 802 for adjusting a size of a ring 108C fabricated according to the disclosure. The apparatus 802 is referred to as a mandrel and is tapered. A ring 108C may be placed on the mandrel 802 and, with a hammer or mallet, be tapped onto a larger diameter portion of the mandrel 802 (to the left, as shown in FIG. 8) to increase the ring size of the ring 108C.

Figure 9:
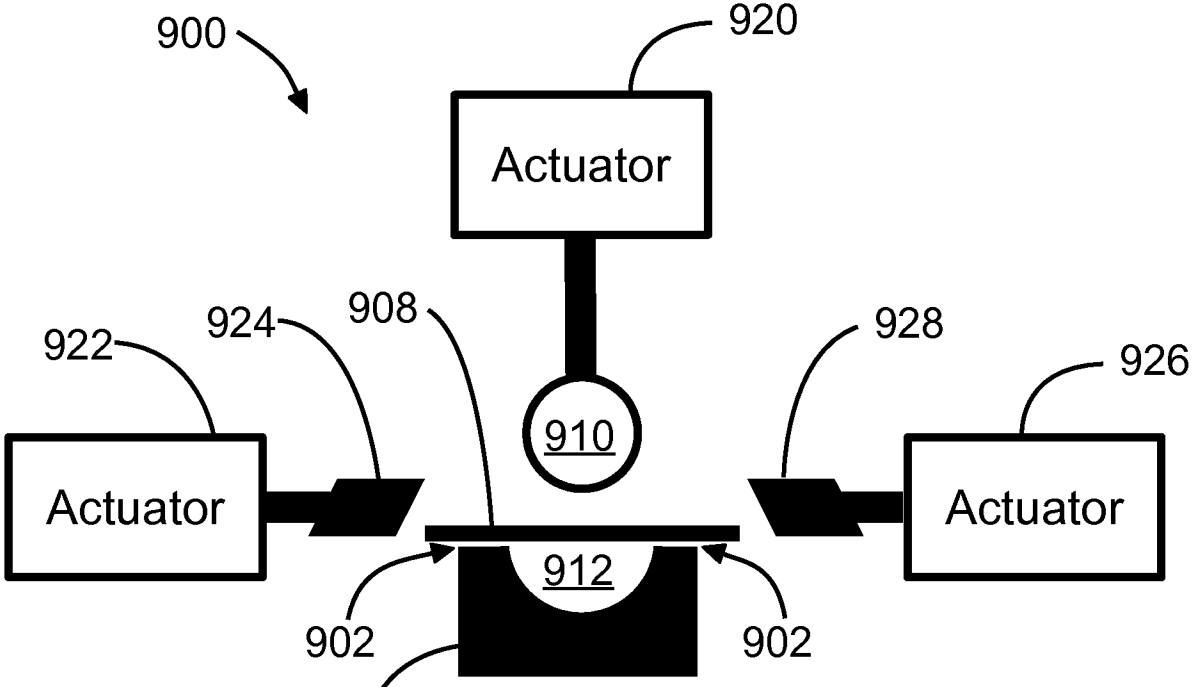
FIGS. 9-11 show a second apparatus performing steps in a second method according to the disclosure.
Figure 10:
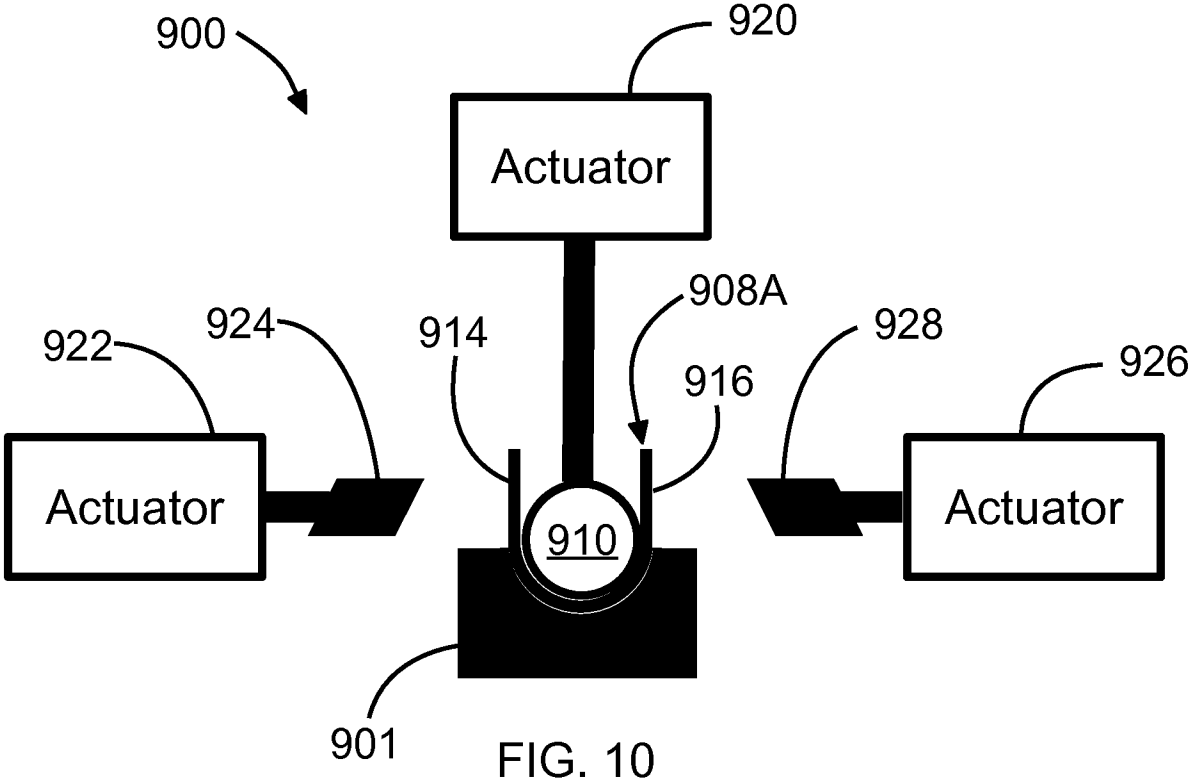
Figure 11:
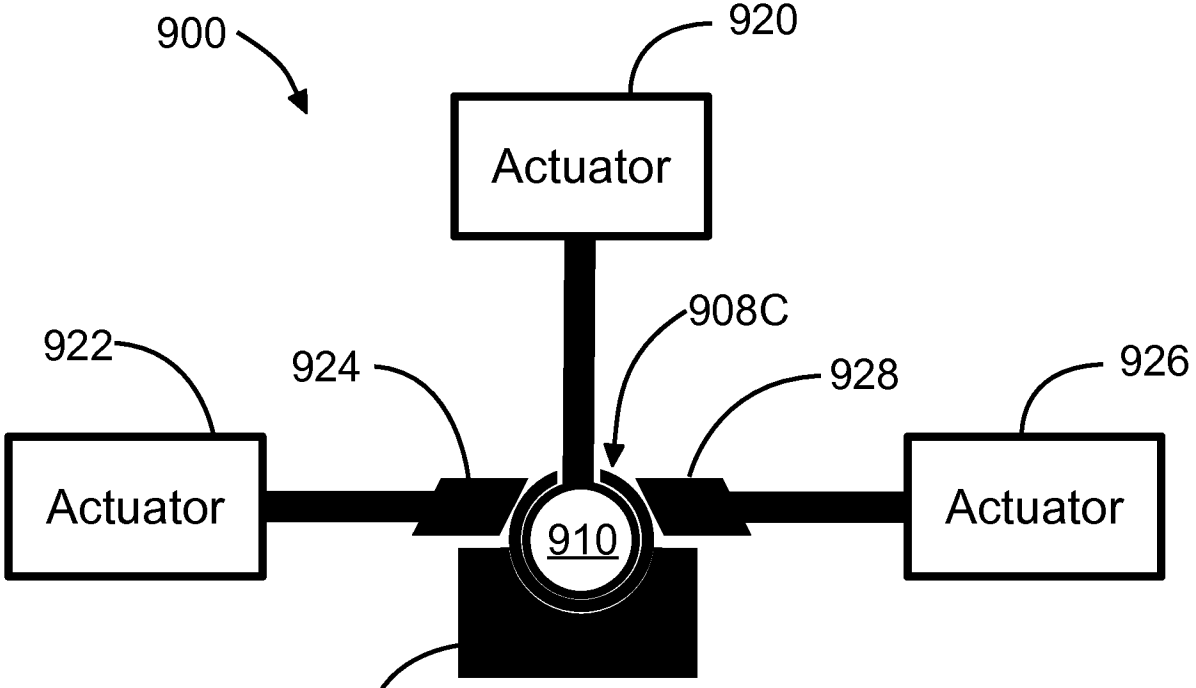

FIGS. 9-11 show a second apparatus 900 performing steps in a second method according to the disclosure. The apparatus 900 includes an anvil 901 having a first surface 902 and a second surface 904. The anvil 901 also includes a shaping aperture 912, between the surfaces 902 and 904. The apparatus 900 also includes a round form 910 attached to an actuator 920, which is configured to press the round form 910 down into the shaping aperture 912. The apparatus 900 further includes a first die 924 attached to an actuator 922 and a second die 928 attached to an actuator 926. The dies 924 and 928 are configured to press in towards the round form 910 from first and second sides, respectively, when the round form 910 is in the shaping aperture 912.

While the round form 910 is refracted from the shaping aperture 912 (as shown in FIG. 9), in a first step of the method, a key 908 may be placed or held across the anvil 901 in a position that the surface 904 supports a blade end portion of the key 908 and the surface 902 supports a bow portion of the key 908. An intermediate portion of the key 908 extends across the shaping aperture 912 between the surfaces 902 and 904.

In a second step of the method, the actuator 920 may be operated to press the round form 910 and the intermediate portion of the key 908 into the shaping aperture 912, as shown in FIG. 10, forming partially wrapped key 908A. A distal portion 914 of the bow portion of the partially wrapped key 908A and a distal portion 916 of the blade portion of the partially wrapped key 908A remain substantially straight after the intermediate portion of the key 908 is pressed into the shaping aperture 912.

In a third step of the method, actuators 922 and 926 are operated to press dies 924 and 928, respectively, into distal portions 914 and 916, respectively, of the partially wrapped key 908A. The result of tis step may be seen in FIG. 11, where wrapped key 908C has been formed around the round form 910. The dies 924 and 928 may then be retracted from the wrapped key 908C, the round form 910 retracted from the shaping aperture 912, and the wrapped key 908C removed from the round form 910.

While the dies 924 and 928 are described as being substantially simultaneously pressed in to the partially wrapped key 908A, it will be understood that in other embodiments one die may be pressed before the other die. As described for the apparatus shown in FIGS. 1-7, the partially wrapped key 908A may be rotated around the round form 910 and the dies 924 and/or 928 pressed again into the partially wrapped key 908A to achieve a desired degree of circularity in the wrapped key 908C.

Based upon the malleability of the key and the power available to operate the press ram, the key may be heated before being shaped into a ring. The more malleable the key and/or the more powerful the shaping apparatus, the less the key may need to be heated. Some keys may not need heating at all before shaping. For the method described with reference to FIGS. 9-11, a speed of operation of one or more of the actuators 920, 922, and 926 may be selected based upon the malleability of the key.

It will be understood that the diameter of the round form 910 will determine the diameter (or ring size) of the wrapped key 908C. In some embodiments, the round form 910 is removably mounted to the actuator 920. In such embodiments, a plurality of removable round forms having differing diameters may be maintained, and a round form of a suitable diameter selected in order to fabricate a ring having a desired ring size.

One or more preparation processes may be applied to a key before the shaping processes described with reference to FIGS. 1-6 and 9-11. Keys may be sorted by a criterion such as material, appearance, etc. Keys may be washed and/or tumbled with abrasive material to remove substances from the surfaces of the keys. A particular key may be selected to use in forming a particular key based upon other criteria such as color, shape, length, etc.

Figure 13:
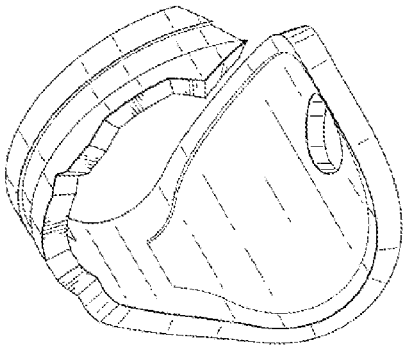
FIG. 13 shows a fashion ring fabricated according to the disclosure.

One or more finishing processes may be applied to either wrapped key 108C or 908C to transform the wrapped key into a fashion ring, such as the ring shown in FIG. 13. In a first finishing process, the wrapped key may be buffed or soaked in a solvent to remove residue from the fabrication process or other materials on the surface of the key.

In another finishing process, the wrapped key may be coated with a hypoallergenic or other non-biologically active material; with a fashion-related material such as gold, silver, platinum, etc.; or with another material having a desirable characteristic.

Figure 14:
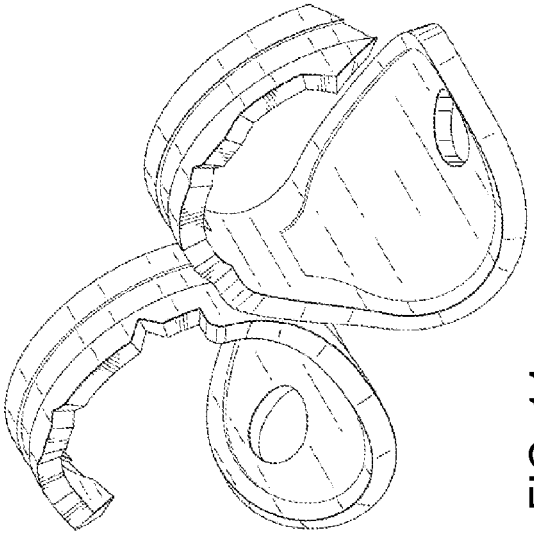
FIG. 14 shows another fashion ring fabricated according to the disclosure.

In still another finishing process, two rings formed by a method according to the disclosure may be attached together, to form a combined ring suitable for wearing on two adjacent fingers. Such a combined ring is shown in FIG. 14. The combined ring may be formed by an adhesive material or by a process such as welding, brazing, soldering, etc. Either or both of the previously discussed finishing processes—removing materials from the surface, and coating the surface—may be applied to such a combined ring.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. A method of fabricating a fashion ring from a key, the method comprising:

supporting a portion of a bow portion of the key on a first surface and an end portion of a blade of the key on a second surface;

forming a wrapped key around a round form by:

pressing the round form into an intermediate portion of the key, located between the bow portion and the blade end portion, to force the key into a shaping aperture between the first and second surfaces, such that the intermediate portion of the key wraps at least partially around the round form, while a distal portion of the bow portion and a distal portion of the blade end remain substantially straight;

pressing a first die into the distal portion of the bow portion to wrap the distal portion of the bow portion around the round form;

pressing a second die into the distal portion of the blade end to wrap the distal portion of the blade end around the round form;

removing the wrapped key from the round form; and applying a finishing process to the wrapped key to form a fashion ring;

the method further comprising repeating the following steps one or more times to form a fully wrapped key with a desired degree of circularity:

rotating the wrapped key around the round form; and at least one of:

pressing the first die into the wrapped key; and pressing the second die into the wrapped key.

2. The method of claim 1, further comprising:

heating the key before the step of supporting.

3. The method of claim 1, wherein the finishing process includes one or more of removing materials from a surface of the wrapped key, coating a surface of the key with a material, and attaching a second wrapped key to the wrapped key to form a combined key.

4. The method of claim 1, wherein the steps of pressing the first die and pressing the second die are performed substantially simultaneously.

5. A method of fabricating a fashion ring from a key, the method comprising:

placing the key on an anvil die, the anvil die having a first surface contacting a portion of a bow portion of the key, a second surface contacting an end portion of a blade of the key, and a shaping aperture between the first and second surfaces under an intermediate portion of the key located between the portion of the bow portion of the key and the end portion of the blade of the key;

pressing a round form into the intermediate portion of the key, to force the intermediate portion of the key into the shaping aperture and at least partially wrap the key around a first portion of the round form;

while the key is held in the shaping aperture by the round form:

pressing a first die into the portion of the bow portion of the key, to force the portion of the bow portion of the key to at least partially wrap around a second portion of the round form;

pressing a second die into the end portion of the blade of the key, to force the end portion of the blade of the key to at least partially wrap around a third portion of the round form, thereby forming a fully wrapped key;

removing the fully wrapped key from the round form; and treating the fully wrapped key to produce a desired finish;

the method further comprising repeating the following steps one or more times to form a fully wrapped key with a desired degree of circularity:

rotating the wrapped key around the round form; and at least one of pressing the first die into the wrapped key and pressing the second die into the wrapped key.

6. The method of claim 5, further comprising:

heating the key before the step of supporting.

7. The method of claim 5, wherein the finishing process includes one or more of removing materials from a surface of the wrapped key, coating a surface of the key with a material, and attaching a second wrapped key to the wrapped key to form a combined key.

8. The method of claim 5, wherein the steps of pressing the first die and pressing the second die are performed substantially simultaneously.

* * * * *